US005341723A

United States Patent [19]

Hung

[11] Patent Number: 5,341,723

[45] Date of Patent: Aug. 30, 1994

[54] RECIPROCATING PNEUMATIC MOTOR FOR HYDRAULICS

[76] Inventor: Michael Hung, 9-16, Nan Kan Hsia, Nan Kan, Lu Chu Hsiang, Tao Yuan County, Taiwan

[21] Appl. No.: 49,299

[22] Filed: Apr. 20, 1993

[51] Int. Cl.[5] ..... F01L 15/12; F01L 25/04

[52] U.S. Cl. ..... 91/224; 91/226; 91/290; 92/181 P; 60/371

[58] Field of Search ..... 91/222, 224, 225, 226, 91/229, 290, 293, 294, 297, 298, 299, 301, 302, 307, 308; 92/181 P; 60/371, 372

[56] References Cited

U.S. PATENT DOCUMENTS

| | | | |
|---|---|---|---|
| 3,278,103 | 10/1966 | Juilfs et al. | 91/308 |
| 3,354,787 | 11/1967 | Takahata | 91/222 |
| 3,561,324 | 2/1971 | Obergfell | 91/308 |
| 3,597,121 | 8/1971 | McClocklin . | |
| 3,726,185 | 4/1973 | Orr | 91/290 |
| 4,028,995 | 6/1977 | Salmi et al. | 91/298 X |
| 4,074,612 | 2/1978 | Miller | 91/290 |
| 4,352,644 | 10/1982 | Landrum et al. . | |
| 4,645,431 | 2/1987 | Spencer et al. | 91/297 X |

*Primary Examiner*—Edward K. Look
*Assistant Examiner*—Hoang Nguyen
*Attorney, Agent, or Firm*—Wenderoth, Lind & Ponack

[57] ABSTRACT

A reciprocating pneumatic motor for hydraulics has a pair of guide grooves on the inner wall of a cylinder provided, together with a pneumatic piston and a shuttle valve to function pneumatically. The piston has a seal ring which passes the guide grooves to allow air to flow into the shuttle compression chamber, pushing the shuttle valve and opening up a channel for the venting of air. This continuous air flow and venting causes the piston to reciprocate. In addition, the piston is integrated with a ring plate using plastic ultrasound technology which simplifies the structure of the pneumatic motor.

5 Claims, 4 Drawing Sheets

FIG,1

RECIPROCATING PNEUMATIC MOTOR FOR HYDRAULICS

BACKGROUND OF THE INVENTION (a) Field of the Invention

The present invention relates to a reciprocating pneumatic motor. More specifically, this invention relates to a pneumatic motor in which a cylinder has guided grooves to provide a reciprocating action for a piston. The piston is integrated with a ring plate using plastic ultrasound technology.

(b) Description of the Prior Art

A conventional pneumatic motor used in a hydraulic jack consists of a cylinder head, a cylinder, a first piston housing, a second piston housing, a piston and a piston rod. Air is supplied from a inlet of the cylinder head and the piston rod reciprocates to continuously move the piston left and right. The air flows into the cylinder and the air pressure forces the piston to go down. When the air is vented, the tension from a spring pushes the piston upward to support the jack. Another improved version of the conventional pneumatic motor uses a vertical action of the cylinder to simplify the structure. But this version of the design requires external connections such as nozzles and fittings, which make the entire structure more complicated. Moreover, the external connections interfere with the assembly process.

SUMMARY OF THE INVENTION

The main object according to the present invention is to provide a design for a reciprocating pneumatic motor for hydraulics in which a inner cylinder wall has a pair of guide grooves. The guide grooves are used for forming an air gap with the seal ring of the piston. Such an air gap allows air to flow into a shuttle compression chamber and pushes a shuttle valve to form a channel for venting the air. This structure causes the piston to reciprocate and eliminates the external tubing and connection. The overall structure is more simplified and avoids difficulties in installation.

Another object according to the present invention is to provide a reciprocating pneumatic motor for hydraulics in which a piston of a pneumatic motor is integrated with a ring plate. This design simplifies the structure of the pneumatic motor.

BRIEF DESCRIPTION OF THE DRAWINGS

The following drawings illustrate an embodiment of the present invention which serves to exemplify the various advantages and objects thereof.

DETAILED DESCRIPTION OF THE PREFERRED EMBODIMENT

Figure 1:
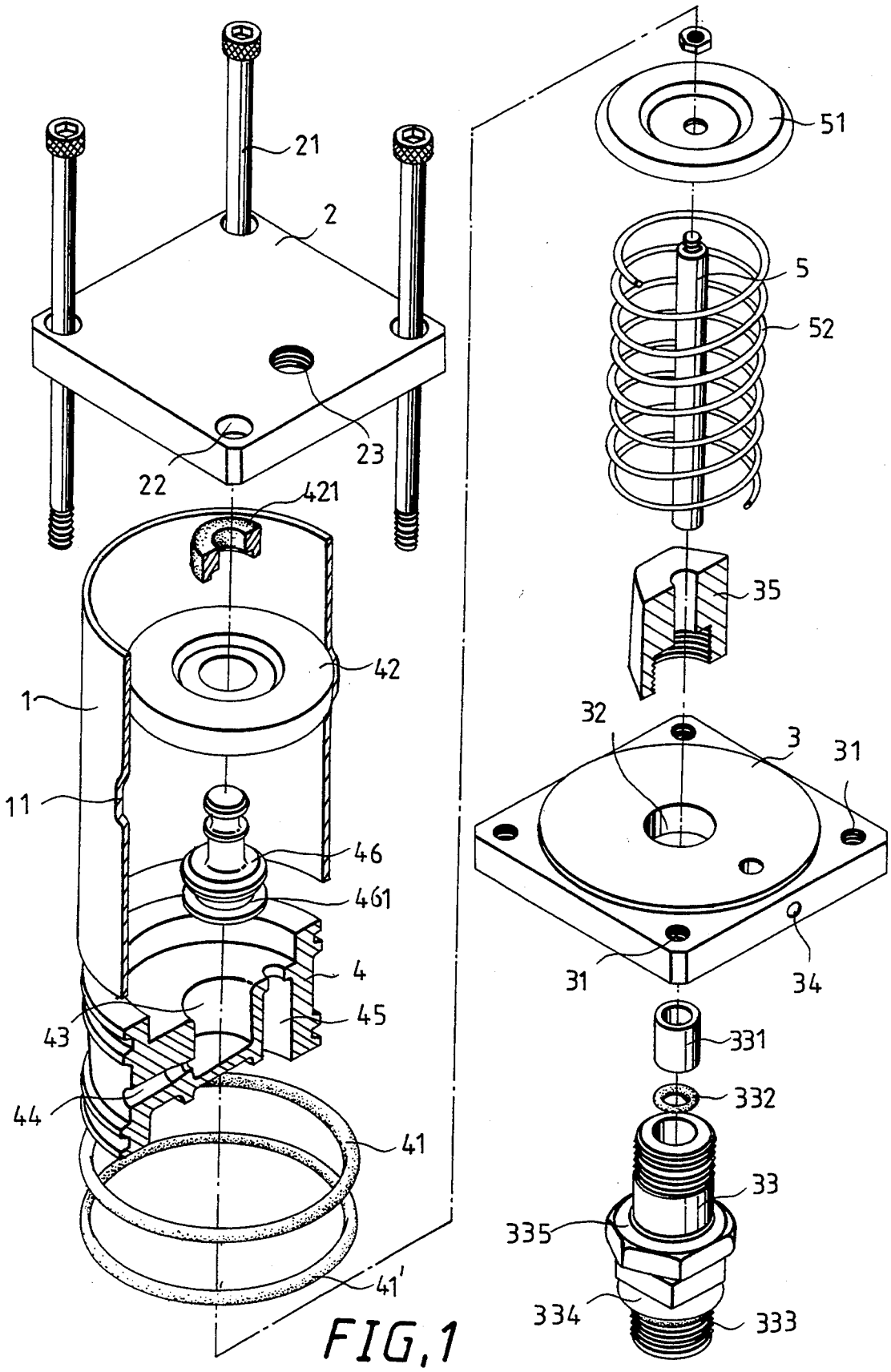
FIG. 1 is an exploded view, in perspective drawing of a pneumatic motor according to the present invention.

As shown in FIG. 1, the reciprocating pneumatic motor according to the present invention mainly comprises a cylinder 1 having a pneumatic piston 4 and a piston rod 5 therein, a cylinder cover 2 and a bottom cover 3. The cylinder 1 has the cylinder cover 2 on its top and the bottom cover 3 on its bottom which covers are bolted together by hex bolts 21. At a selected location in the cylinder body is a pair of corresponding guide grooves 11 which protrude from the exterior wall. The guide grooves 11 are punched directly during fabrication and do not require additional machining or grinding. The cylinder cover 2 has bolt holes 22 in the four corners thereof for the hex bolts 21 to extend through and an air inlet hole 23 is opened at a selected location on the cylinder cover 2. The bottom cover 3 also has bolt holes 31 in the four corners thereof for the hex bolts 21 to be screwed in. The center of the bottom cover 3 has a central hole 32 for a piston pump 33 to extend through. The surface and the edge of the bottom cover 3 have a plurality of L-shaped holes 34. The inside diameter of an upper portion of the piston pump 33 has a liner 331 and an O-ring 332 which extend through the bottom cover 3 and lock onto a piston pump cover 35. The lower portion of the piston pump. 33 has a square oil seal 333, a washer 334 and a hex nut 335. The pneumatic piston 4 is a circular body having a first seal ring 41 on its top and a second seal ring 41' on its bottom. The circular body of the pneumatic piston 4 has an indented surface on which a ring plate 42 is joined with an appropriate gap 22, as shown in FIG. 2.

The central part of the indented surface of the circular piston body has a central slotted hole 43 from which a radial air inlet hole 44 is connected. The indented surface has an air vent hole 45 which is located closely to the central slotted hole 43. A shuttle valve 46 is inserted into the central slotted hole 43 and operates between the main body of the pneumatic piston 4 and the ring plate 42. A seal sing 421 is installed on a portion extending from the ring plate 42. The end portion of the shuttle valve 46 has an oil seal 461 which is used to maintain air tightness between the shuttle valve 46 and the inner wall of the central slotted hole 43. Therefore, a shuttle compression chamber 47 is formed between the bottom of the shuttle valve 46 and the bottom of the central slotted hole 43 such that the shuttle compression chamber 47 is open to the radial air inlet hole 44, as shown in FIG. 2. The piston rod 5 has one end extending through the piston pump cover 35 into the piston pump 33 and the other end is locked onto a spring base 51 from which a coiled spring 52 is attached. The spring base 51 is snug to the bottom of the pneumatic piston 4. The stretching of the coiled spring 52 enables the reciprocating movement of the piston rod 5. This principle is similar to a conventional design and is not going to be described here.

Figure 2:
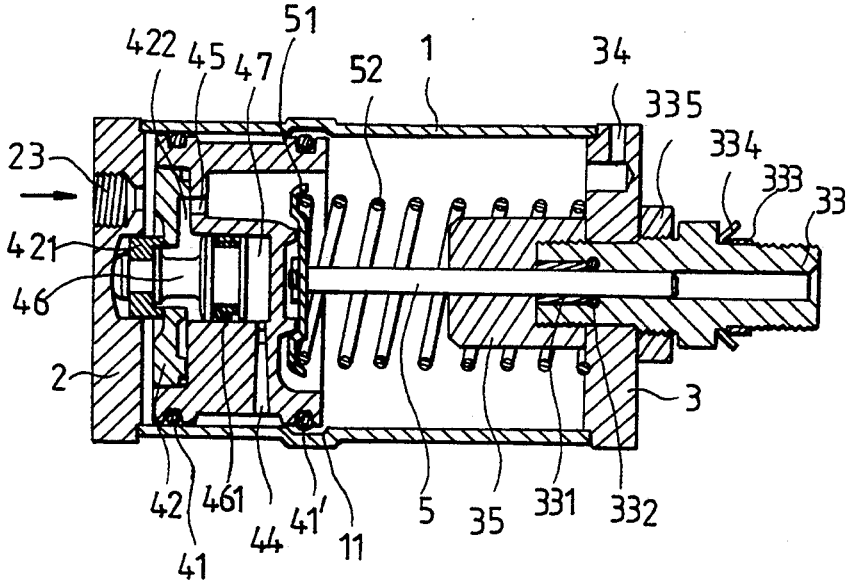
FIG. 2 is a cross-sectional view of the motor in a stage before compression according to the present invention.
Figure 3:
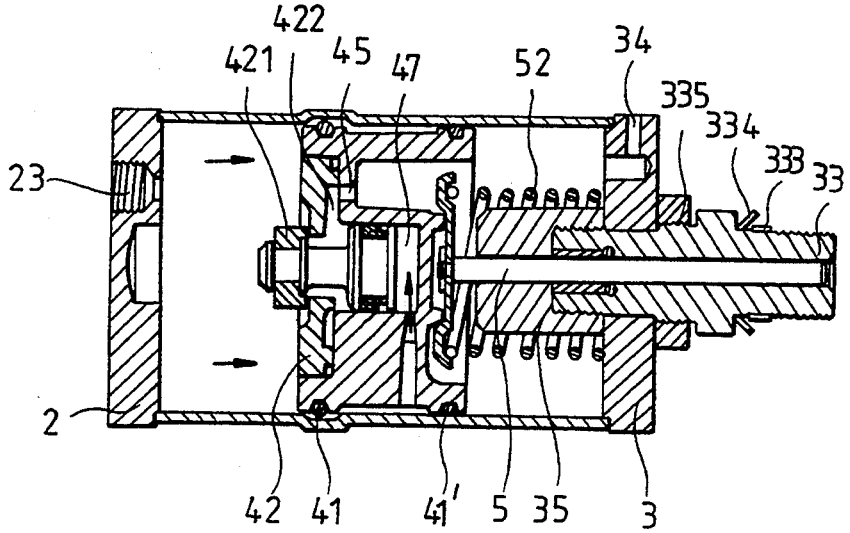
FIG. 3 is a cross-sectional view of the motor showing the external air enters the cylinder to push the pneumatic piston according to the present invention.
Figure 4:
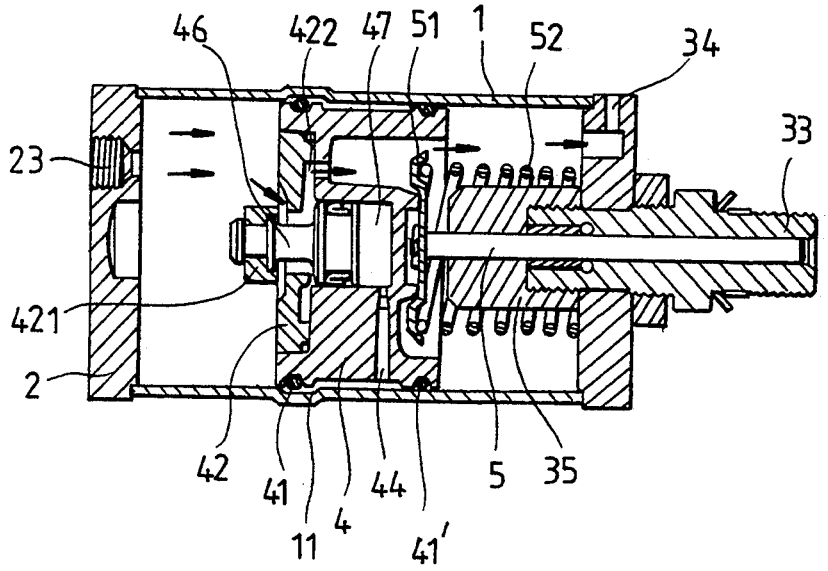
FIG. 4 is a cross-sectional view of the motor showing the shuttle valve in an open position according to the present invention.
Figure 5:
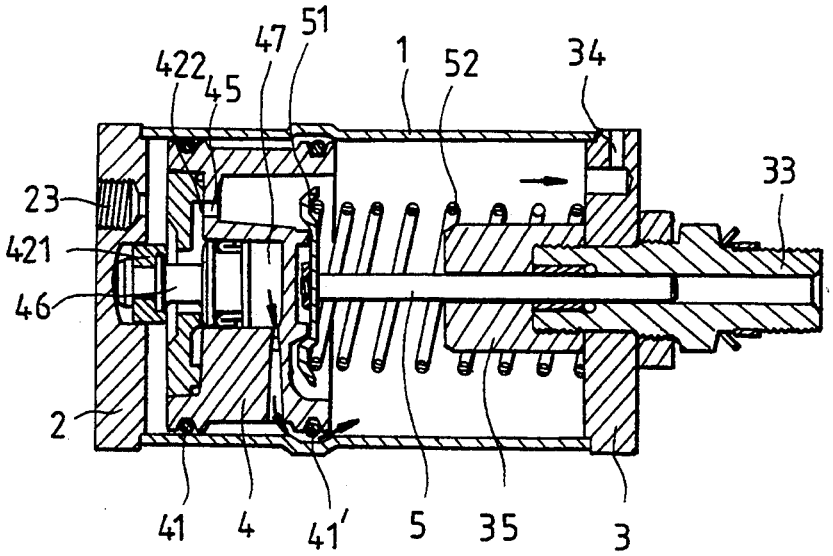
FIG. 5 is a cross-sectional view of the motor scheme showing the shuttle valve in a closed position at the end of the first cycle of the operation according to the present invention.
Figure 6:
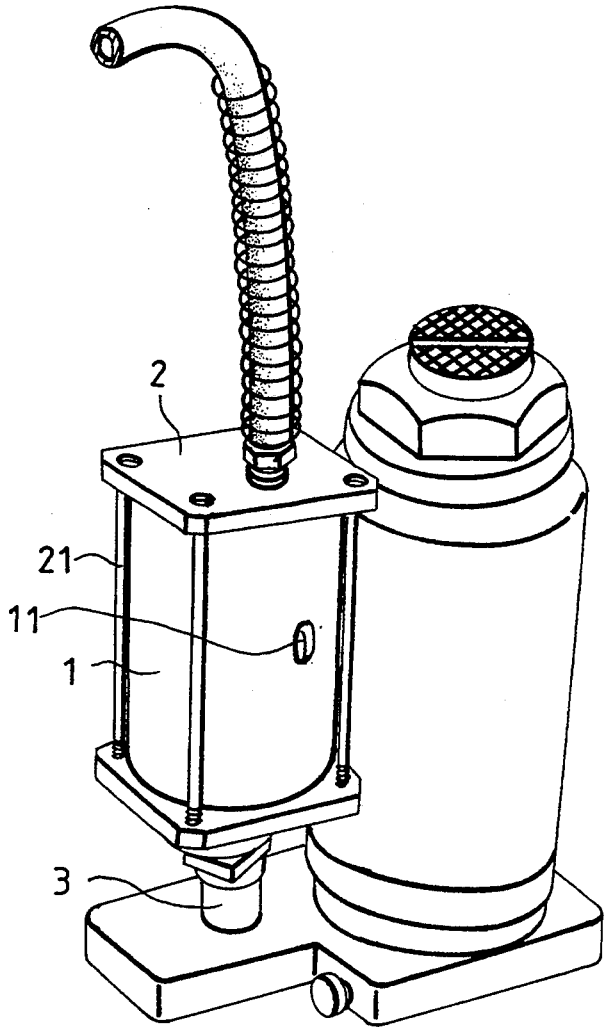
FIG. 6 is a perspective view of a hydraulic jack with the reciprocating pneumatic motor according to the present invention.

Referring to FIG. 2 and FIG. 3, compressed air entering from the air inlet hole 23 of the cylinder cover 2 pushes the pneumatic piston 4 forward. When the first seal ring 41 passes the guided grooves 11, a gap is formed. This gap allows the air to pass through the radial air inlet hole 44 and into the shuttle compression chamber 47, as shown in the direction of the arrow in FIG. 3. Since the bottom surface area of the shuttle valve 46 is larger than its top surface area, therefore, under the same force condition, the pressure exerted on the bottom surface area is higher that of the top surface area. This higher pressure can push the shuttle valve 46 forward and open up the air vented hole 45. At the same time, an air gap is formed (as shown in FIG. 4) between the shuttle valve 46 and the ring plate 42 which allows air to pass through to the air vented hole 45 and rapidly vent through the L-shaped holes 34 to the outside. The venting lowers the pressure to a point that the tension of the coiled spring 52 pushes the piston rod 5 backward to its original state. The remaining air in the shuttle compression chamber 47 passes through the gap between the second seal ring 41' and the guided grooves 11 and is vented out through the L-shaped holes 34, as shown in FIG. 5. When the air in the shuttle compression chamber 47 is completely vented, the shuttle valve 46 shuts off automatically and returns to its original state, as shown in FIG. 2. The compressed air going in and the venting are happening instantaneously, is therefore the piston rod 5 is reciprocating.

The structure of the pneumatic piston 4 as described has an indented surface in the front portion of its body which is made to fit with the ring plate 42 using the ultrasound technology. This structure simplifies the assembly process as compared to the fabrication of an entire pneumatic piston set. In addition, the gap 422 may be reserved between the ring plate 42 and the indented surface of the piston to control the inlet air flow direction for the reciprocating of the piston rod 5.

What is claimed is:

1. A reciprocating pneumatic motor for a hydraulic pump, comprising:

a cylinder having an inner wall and an exterior wall, said cylinder having guide grooves punched in said inner wall thereof such that said exterior wall protrudes, and said guide grooves being located at a predetermined location along said inner wall of said cylinder;

a cylinder cover on one end of said cylinder;

an air inlet at said one end of said cylinder;

a bottom cover on the other end of said cylinder bolted to said cylinder cover with said cylinder therebetween, said bottom cover having a central hole therein, said central hole having a piston pump component extending therethrough and fixed therein, said piston pump component having a piston pump cover fixed thereto extending into said cylinder, and said bottom cover further having a plurality of L-shaped holes therein communicating the inside of said cylinder with the outside of said cylinder;

a pneumatic piston in said cylinder having a circular body with top and bottom ends, a first seal ring on said top end and a second seal ring on said bottom end, a front portion facing said cylinder cover, a rear portion facing said bottom cover, a central hole facing said cylinder cover, a ring plate on said front portion, said ring plate having a central aperture, a shuttle valve disposed in said central hole and extending through said central aperture of said ring plate, a seal ring on said shuttle valve between said ring plate and said cylinder cover adapted to open and close said central aperture, an end portion on said shuttle valve sidably disposed in said central hole and having an oil seal that forms an air tight seal between said shuttle valve and said central hole, an air vent hole communicating the bottom end of said pneumatic piston with said central aperture of said ring plate, a shuttle compression chamber between said shuttle valve and said central hole, and a radial air inlet communicating said shuttle compressison chamber with the exterior of said circular body between said first and second seal rings; and a piston rod having one end extending into said piston pump cover and said piston pump component and another end connected to a spring base, said spring base being biased snug against said bottom end of said circular body of said pneumatic piston by a spring.

2. The motor of claim 1, wherein said front portion has an indented surface receiving said ring plate, said ring plate being integrated with said front portion of said circular body by plastic ultrasound technology.

3. The motor of claim 2, wherein a gap is defined between said indented surface and said ring plate.

4. The motor of claim 2, wherein said piston pump cover extends to a point in said cylinder such that, when said pneumatic piston is located such that said first seal ring is positioned at said guide grooves, said rear portion of said pneumatic piston is substantially aligned with an end of said pump cover.

5. The motor of claim 1, wherein said piston pump cover extends to a point in said cylinder such that, when said pneumatic piston is located such that said first seal ring is positioned at said guide grooves, said rear portion of said pneumatic piston is substantially aligned with an end of said pump cover.

* * * * *